United States Patent [19]

Kvapil

[11] 4,385,784

[45] May 31, 1983

[54] METHOD FOR FORMING AN IN SITU OIL SHALE RETORT

[75] Inventor: Rudolph Kvapil, Golden, Colo.

[73] Assignee: Occidental Oil Shale, Inc., Grand Junction, Colo.

[21] Appl. No.: 200,639

[22] Filed: Oct. 27, 1980

[51] Int. Cl.[3] ..... E21C 41/10

[52] U.S. Cl. ..... 299/2; 299/13; 102/312

[58] Field of Search ..... 299/2, 13; 166/299; 102/311, 312

[56] References Cited

U.S. PATENT DOCUMENTS

| | | | |
|---|---|---|---|
| 3,001,776 | 9/1961 | Van Poollen | 299/2 |
| 3,537,753 | 11/1970 | Arendt | 299/2 |
| 3,588,175 | 6/1971 | Whiting | 299/13 |
| 4,176,882 | 12/1979 | Studebaker et al. | 299/2 |

*Primary Examiner*—Ernest R. Purser

*Attorney, Agent, or Firm*—Christie, Parker & Hale

[57] ABSTRACT

A retort site in a subterranean formation containing oil shale is prepared for in situ retorting by excavating a void space in the retort site and then explosively expanding at least a portion of the remainder of the formation within the retort site toward the void space. The resultant fragmented mass explosively expanded toward the void space will be permeabilized by the void volume of the void space. The void space is initially formed by excavating at least three substantially parallel drifts through the retort site. At least two of the drifts are along opposed outside edges of the retort site and at least one drift is intermediate the two outside drifts. Excavation of the void space is conducted from the two outside drifts. A vertically extending slot is first excavated from each such drift upwardly into the proposed void space at one end of the retort site. The slot may be fanned above the drift so that the slots from the two outside drifts meet near the top of the void space. Upwardly extending shot holes are then drilled from each of the outside drifts parallel to the vertical slot. If the vertical slot is fanned, it is desirable to also drill the upwardly extending shot holes in a fanned pattern. The shot holes are then loaded with explosive and blasted and the resultant rubble excavated through the outside drifts. By gradually working along the length of the outside drifts, excavation of the void space can proceed with men and equipment safely within the outside drifts. The substantially triangular prism remaining in the void space intermediate the edges of the retort site can then be fragmented by means of shot holes drilled from the third intermediate drift extending through such prism.

37 Claims, 7 Drawing Figures

METHOD FOR FORMING AN IN SITU OIL SHALE RETORT

FIELD OF THE INVENTION

This invention relates to the forming of a fragmented permeabilized mass of formation particles in an in situ oil shale retort.

BACKGROUND OF THE INVENTION

The invention relates to a technique for forming a fragmented permeable mass of particles in an in situ oil shale retort. More particulary, this invention relates to technique for excavation of a void space in a proposed retort site and explosive expansion of oil shale formation into the void space for forming an in situ oil shale retort.

The presence of large deposits of oil shale in the Rocky Mountain region of the United State has given rise to extensive efforts to develop methods for recovering shale oil from kerogen in the oil shale deposits. Oil shale is a sedimentary formation comprising marlstone deposit with layers containing an organic polymer called "kerogen". Upon heating the kerogen decomposes to produce liquid and gaseous products. The formation containing kerogen is called "oil shale" herein, and the liquid hydrocarbon product is called "shale oil."

A number of methods have been proposed for processing oil shale; these generally involve either mining the kerogen-bearing shale and removing it to the surface for processing into shale oil or rubblization and processing of the shale in situ. The latter approach is preferable from the standpoint of environmental impact, since the treated shale remains in place, reducing the chance of surface contamination and the requirement for disposal of solid wastes.

The recovery of liquid and gaseous products from oil shale deposits have been described in several patents, such as U.S. Pat. Nos. 3,661,423; 4,043,595; 4,043,596; 4,043,597, and 4,043,598 which are incorporated herein by this reference.

These patents describe in situ recovery of liquid and gaseous hydrocarbon materials from a subterranean formation, containing oil shale, wherein such formation is explosively expanded to form a stationary, fragmented permeable body or mass of formation particles containing oil shale within the subterranean formation, referred to herein as an "in situ oil shale retort" or "retort." Retorting gases are passed through the fragmented mass to convert kerogen contained in the oil shale to liquid and gaseous products, thereby producing retorted oil shale. One method of supplying hot retorting gases used for converting kerogen contained in the oil shale (as described in U.S. Patent No. 3,661,423) includes establishing a combustion zone in the retort and introducing an oxygen-supplying retort inlet mixture into the retort to advance the combustion zone through the fragmented mass. In the combustion zone, oxygen from the retort inlet mixture is depleted by reaction with hot carbonaceous materials to produce heat, combustion gas, and combusted oil shale. Continued introduction of the retort inlet mixture into the fragmented mass, advance the combustion zone through the fragmented mass in the retort.

The combustion gas and that portion of the retort inlet mixture which does not take part in the combustion process pass through the fragmented mass on the advancing side of the combustion zone to heat the oil shale in a retorting zone to a temperature sufficient to produce kerogen decomposition, called "retorting." Such decomposition in the oil shale produces gaseous and liquid products, including gaseous and liquid hydrocarbon products, and a residual solid carbonaceous material.

The liquid products and the gaseous products are cooled by the cooled oil shale fragments in the retort on the advancing side of the retorting zone. The liquid hydrocarbon products, together with water produced in or added to the retort, collect at the bottom of the retort and are withdrawn. An off gas, which can include hydrocarbons, carbon dioxide generated in the combustion zone and from carbonate decomposition, gaseous products produced in the retorting zone, and any gaseous retort inlet mixture that does not take part in the combustion process is also withdrawn from the bottom of the retort. The products of retorting are referred to herein as liquid and gaseous products.

It is desirable to form a fragmented mass having a relatively uniform distribution of the void fraction, i.e., a fragmented mass of reasonably uniform permeability, so that oxygen-supplying gas can flow uniformly through the fragmented mass during retorting operations. Techniques used for excavating void spaces in a retorting site and for explosively expanding formation toward the voids can affect the uniformity of particle size or permeability of the fragmented mass. A fragmented mass having reasonably uniform permeability in horizontal planes across the fragmented mass can avoid bypassing portions of the fragmented mass by retorting gas, which can otherwise occur if there is gas channelling through the fragmented mass owing to non-uniform permeability.

It is desirable that techniques used in excavating and explosively expanding formation within an in situ oil shale retort site provide a means for controlling the void fraction distribution within a fragmented mass being formed so that a reasonably distribution of the void fraction can be provided in the resulting fragmented mass.

An in situ retort formed by excavating a large void in the retort site and then explosively expanding formation above and/or below the void into the void can result in substantially uniform distribution of the void fraction throughout the rubblized mass of formation particles in the retort. Such a technique has certain hazards for miners excavating such a void because of the large unsupported expanses under which the miners would have to work. This is true even though oil shale, especially that found in the Western United States is generally considered to be quite competent and can remain open even for substantial periods with relatively large spans. It is, therefore, desirable to provide a technique for forming an in situ oil shale retort wherein the excavation of an underlying void can be performed from a safe location.

SUMMARY OF THE INVENTION

The present invention relates to a method of forming a subterranean oil shale retort containing a fragmented permeable mass of oil shale particles. The method comprises excavating at least one void space in the subterranean retort site and then explosively expanding at least a portion of the remainder of the formation within the retort site toward the void space. Excavation of the void space is commenced by driving at least three substantially parallel production drits through the retort site. At least two excavation drifts are positioned adjacent to the opposed outside edges of one axis of the retort site and at least one drift is positioned intermediate the two excavation drifts.

A substantially vertical, upwardly extending slot is then excavated from each of the excavation drifts into the proposed void space at one boundary of the retort site. The slot may be fanned above each drift so that the slots fom the two excavation drifts meet near the top of the void space leaving a triangular prism of unfragmented formation surrounding the intermediate drift. The slots form free faces for subsequent blasting of adjacent formation.

A series of upwardly extending shot holes are then drilled from the excavation drifts into the unfragmented formation up to the vertical extent of the void space. The shot holes are drilled substantially parallel to the slots and, if the slots have been fanned, the shot holes are similary fanned. The shot holes are then loaded with explosive and the surrounding formation in the proposed void space is explosively expanded into the excavation drifts. Loaders and other similar equipment working within the confines of the excavation drifts remove the resultant rubble.

This procedure of drilling shot holes, explosive expansion of formation in the proposed void space and removal of resultant rubble is repeated in a pattern retreating along the excavation drifts for the full extent of the retort site. The substantially triangular prism remaining in the void space intermediate the edges thereof can then be fragmented by means of shot holes drilled from the intermediate drift extending through such prism.

Shot holes are then drilled into unfragmented formation above and/or below the void space, loaded with explosive and blasted to explosively expand the formation toward the void space. The resultant fragmented mass is permeabilized by the void volume of the void space.

DRAWINGS

These and other aspects of the invention will be more fully understood by referring to the following detailed description and the accompanying drawings in which.

DETAILED DESCRIPTION

Figure 1:
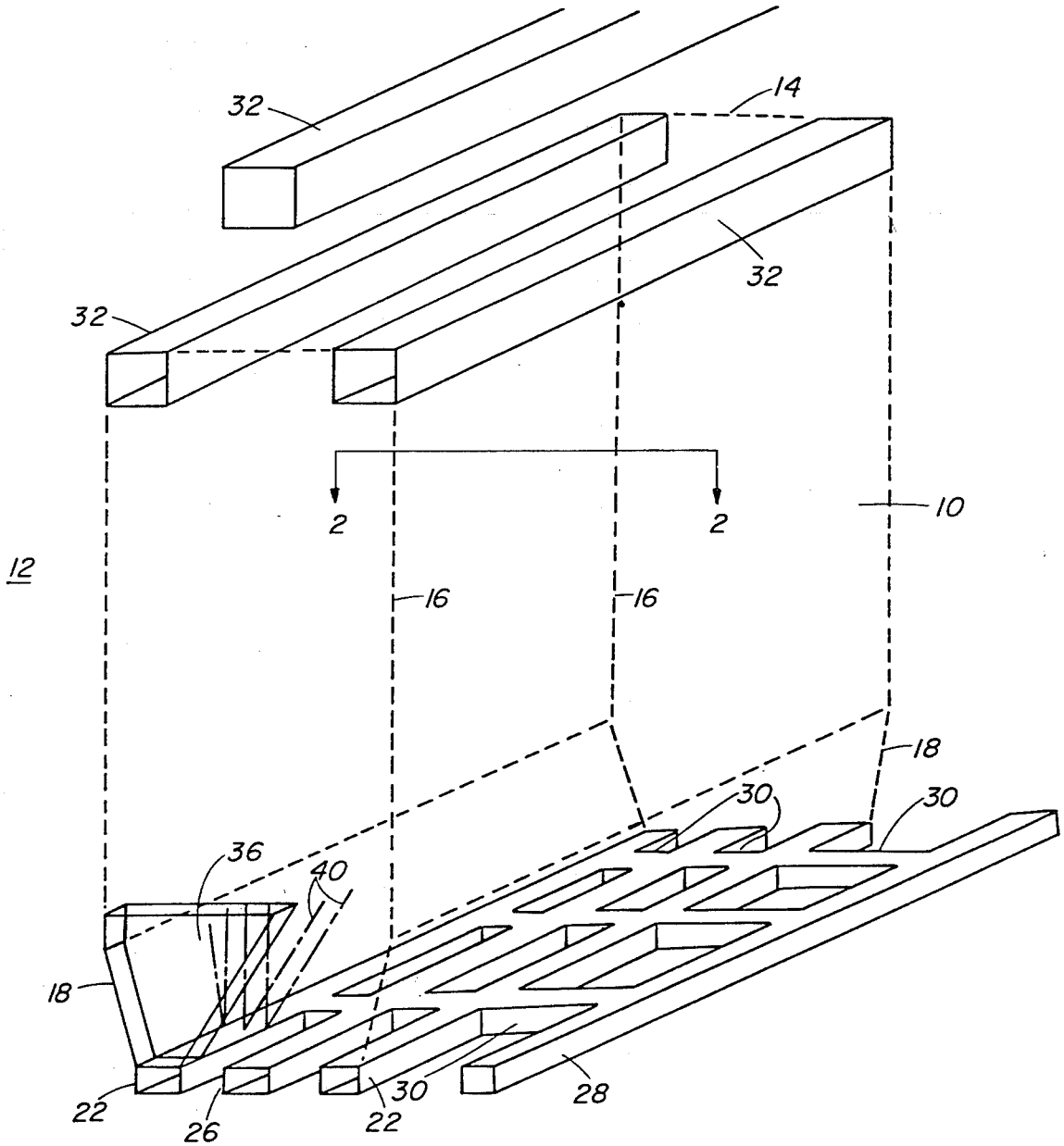
FIG. 1 is a schematic perspective view of excavations illustrating an in situ oil shale retort site at an initial stage of development with the excavations shown in solid line and the final retort boundaries indicated in dashed lines as if the oil shale were transparent.
Figure 2:
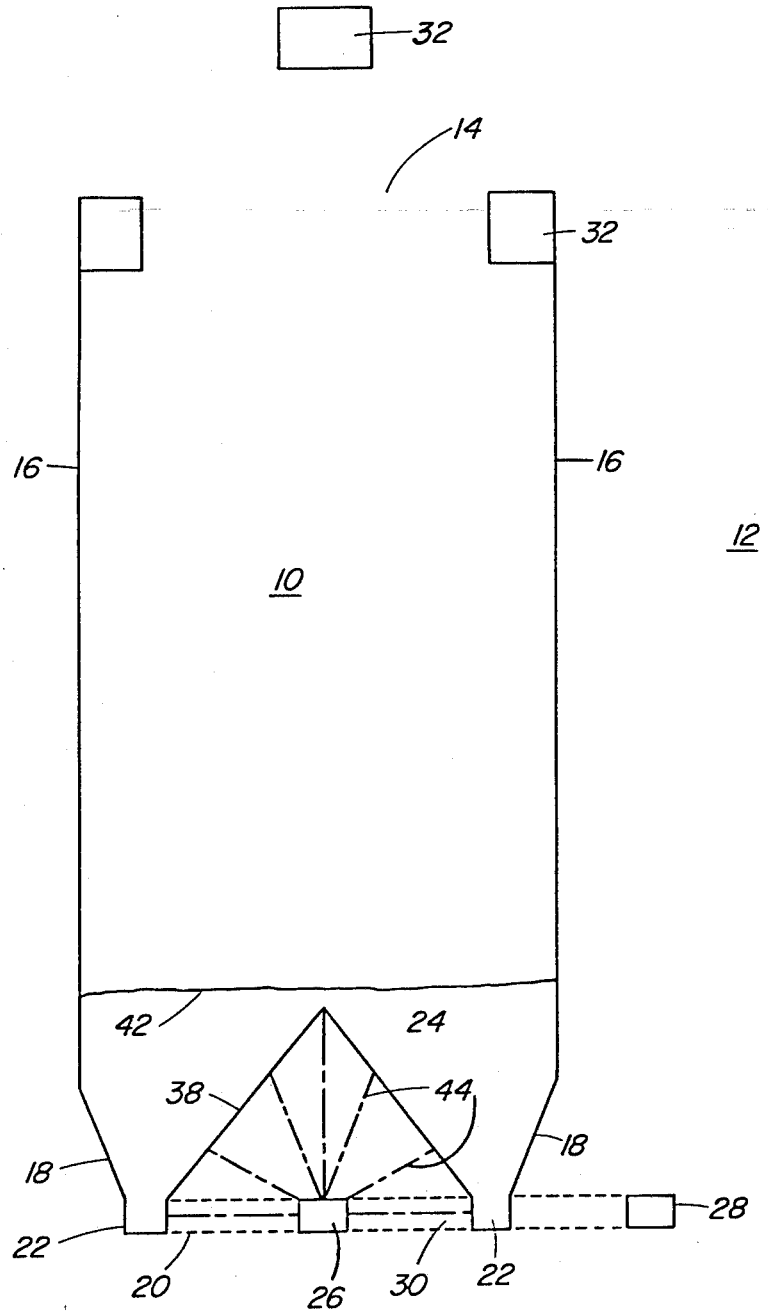
FIG. 2 is a framentary, semi-schematic vertical cross-section taken on line 2—2 of FIG. 1 at a later stage of development.
Figure 3:
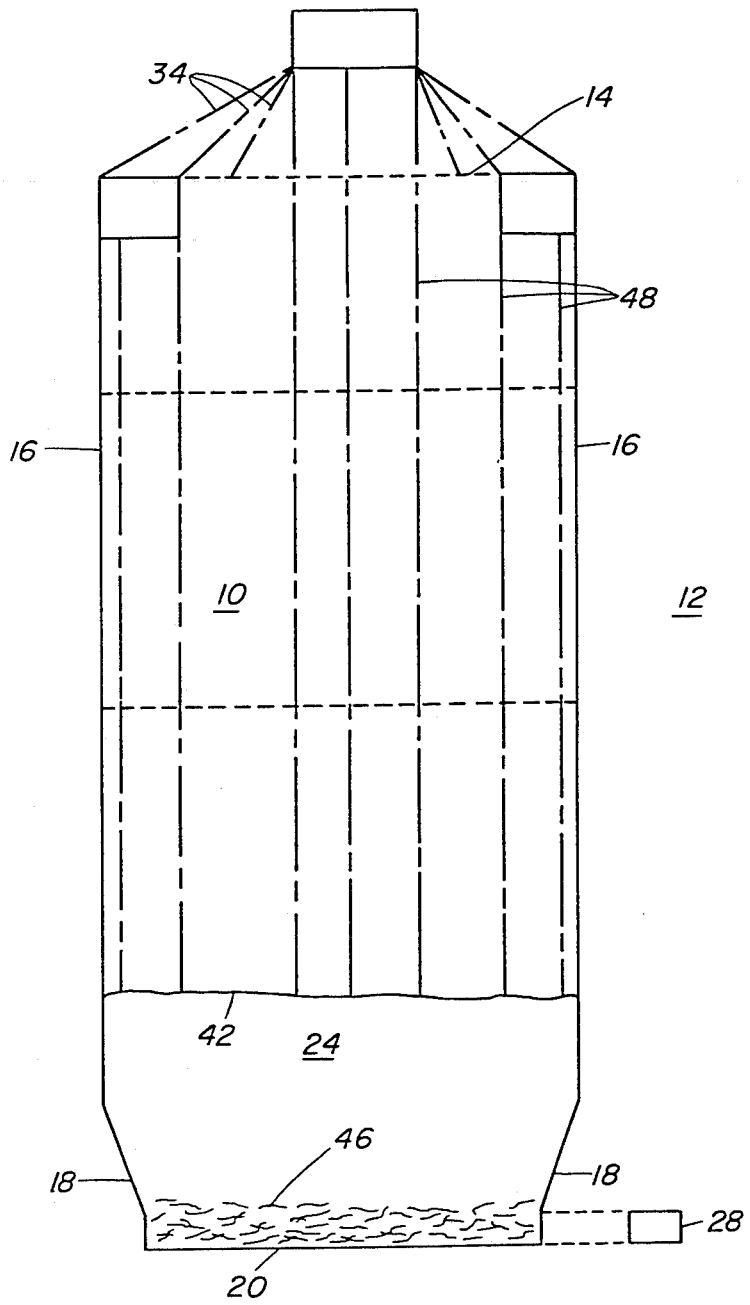
FIG. 3 is a fragmentary, semi-schematic vertical cross-section also taken on line 2—2 of FIG. 1 at a later stage of development.

FIGS. 1 through 3 schematically illustrate the initial stages of development of an in situ oil shale retort being formed in accordance with principles of this invention. The in situ retort is formed in a subterranean formation 12 containing oil shale. The in situ retort illustrated in FIGS. 1 through 3 is retangular in horizontal cross-section, having a top boundary 14, four side boundaries 16, four downwardly and inwardly converging lower boundaries 18 which form a tapered lower portion of the retort being formed and a bottom boundary 20. The dimensions of the lateral and longitudinal axis of the illustrated retort are shown as being of different lengths; it being understood, however, that a retort with equal lateral and longitudinal axes or a retort of any other shape or with any other number of sides is also within the scope of the present invention.

The in situ retort 10 is formed by excavating a void space within the confines of the retort site and then explosively expanding formation above and/or below the void space into the void space. The volume of the void space is from about 10 to about 40%, preferably from about 15 to about 25% of the total volume of the retort site. Explosive expansion of the unfragmented formation into the void space distributes the volume of the void space into the resultant fragmented mass so that the fragmented mass will contain a void volume of from about 10 to about 40%. The void space may be excavated at the bottom of the retort, at the top of the retort, at one or more elevations intermediate the top and bottom, or combinations thereof. In the preferred embodiment the void space is at the bottom of the retort. For simplicity of description each of the embodiments of the present inventions illustrated herein will be shown with the void space being excavated at the bottom of the retort; it being understood, however, that the void space may be at other locations or more than one location within the retort site.

Figure 4:
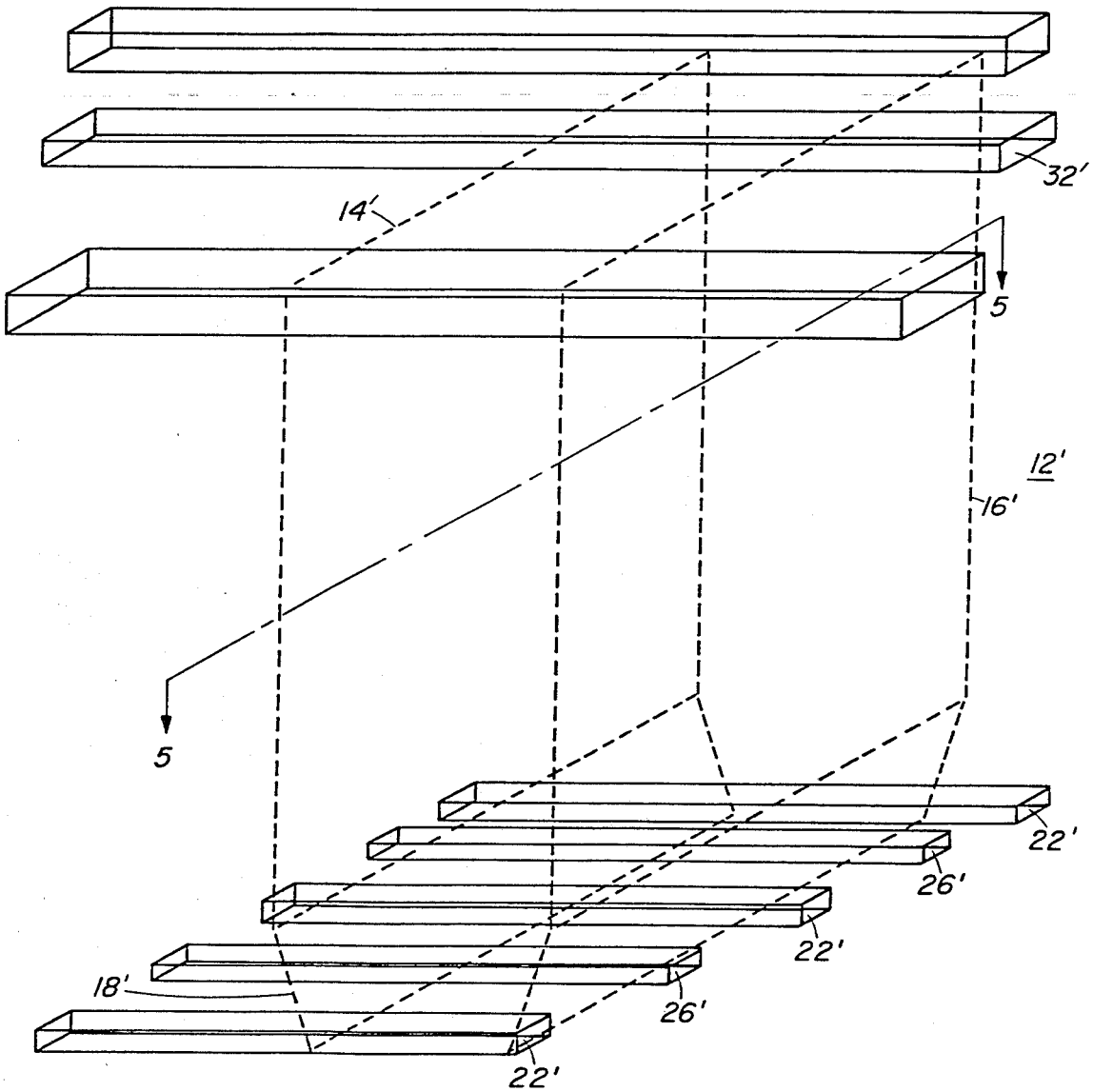
FIG. 4 is a schematic perspective view of excavations similar to FIG. 1 and showing another embodiment of the principles of the invention.
Figure 5:
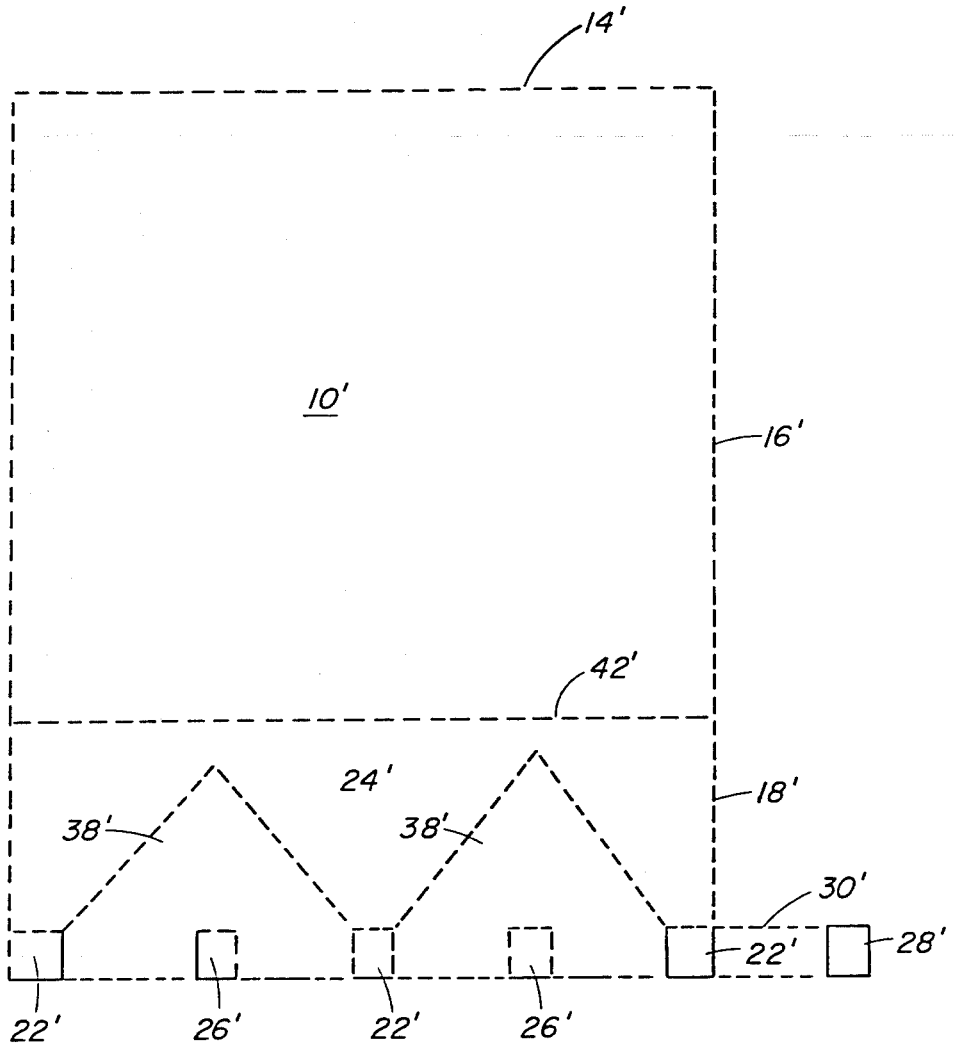
FIG. 5 is a fragmentary, semi-schematic vertical cross-section taken on line 5—5 of FIG. 4.

Excavation of the void space is commenced by driving at least three production drifts through the retort site; the production drifts are substantially parallel to each other and to an axis of the retort site. FIGS. 1 through 3 show three production drifts along the longitudinal axis of the retort site; two excavation drifts 22 providing access to the void space 24 in a manner to be described in greater detail hereinafter, and one intermediate drift 26, for rubblization of the unfragmented prism, also to be described in greater detail hereinafter. FIGS. 4 and 5, which illustratively depict another embodiment of the principles of the present invention, shown five production drifts along the lateral axes of the retort site; three excavation drifts 22' and two intermediate drifts 26'. As will be readily appreciated there will always be an odd number of production drifts, i.e., 3,5,7, etc.

A production drift 28 may, if desired, be excavated through the formation adjacent to the retort site to provide access to and assist in the removal of rubble drawn from the void space 24. A series of spaced apart cross-drifts 30 interconnecting production drifts 22, 26, and 28 may also be excavated, if desired, for ventilation and to assist in removal of rubble from the void space 24.

A series of drilling drifts 32 may be excavated through the retort site at and/or adjacent to the top boundary 14 of the retort. The drilling drifts can provide access across the entire retort sit for drilling of shot holes to position explosives in the unfragmented formation in a manner to be described in greater detail hereafter. The drilling drifts also provide access to the retort for introduction of burners, fuel and an oxygen supplying gas, etc., during the ignition of the retort, and for introduction of an oxygen supplying gas and steam, etc. during the retorting process. Alternatively, the shot holes and other access portals to the retort required during ignition and retorting, can be drilled from the surface.

Figure 6:
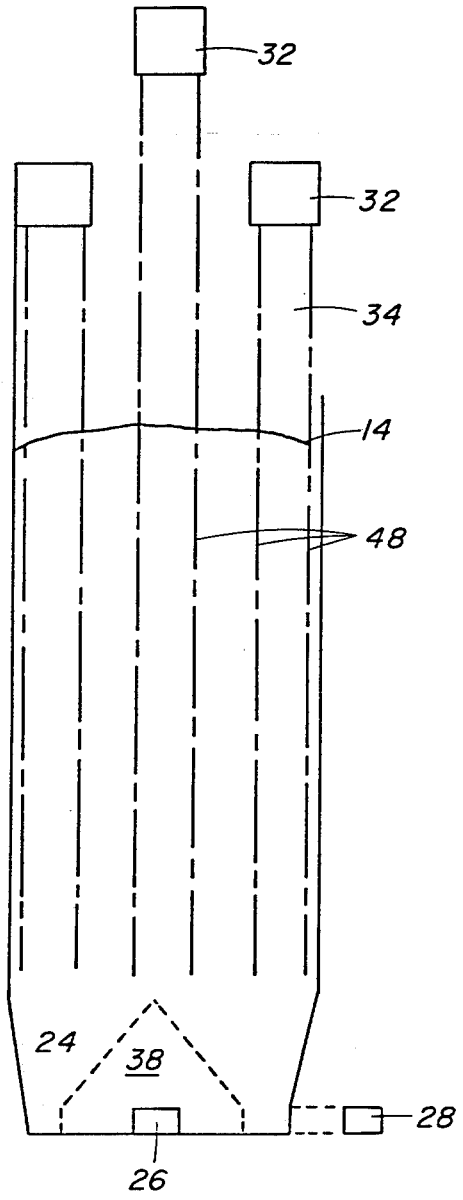
FIG. 6 is a fragmentary, semi-schematic vertical cross-section showing another embodiment of the principles of this invention; and , FIG. 7 is a fragmentary, semi-schematic vertical cross-section showing still another embodiment of the principles of this invention.

The drilling drifts are preferably parallel to the production drifts and may be in the same plane or vertically spaced apart from each other on different elevations. Similarly, one or more of the drilling drifts may be at the same elevation as the top of the retort or they may be located above the top of the retort separated from the retort by a sill pillar, as shown in FIG. 6. The number of drilling drifts and the dimensions of each such drift is largely dependent upon the dimensions of the retort. As best shown in FIGS. 1–3, the preferred embodiment is to have a plurality of horizontally spaced apart drilling drifts across the full extend of the retort, at least one of which is along the top of the retort and at least one of which is positioned above the top of the retort site, along an edge of the retort or outside the retort site in unfragmented formation. The air level provides access to the retort during the ignition and retorting processes subsequent to rubblization, by means of drill holes 34.

Formation of the void space is conducted from the two excavation drifts 22. A vertical slot 36 is extended upwardly from each of the excavation drifts 22 into the proposed void space 24, preferably at one boundary of the retort site. The slot extends upwardly for the full vertical height of the proposed void space. Preferably the slot above each drift is fanned toward the vertical slot mined above the adjacent excavation drift, so that the slots meet near the top of the void space leaving a substantially triangular prism 38 of unfragmented formation surrounding the intermediate drift 26. The slots provide free faces for subsequent blasting of adjacent formation.

A series of upwardly extending shot holes 40 are drilled from the excavation drifts parallel to the vertical slot 36. In the embodiment of the present invention wherein the slot is fanned, the shot holes 40 are also preferably fanned. The shot holes 40 are then loaded with explosive and the surrounding formation in the proposed void space 24 is explosively expanded downwardly into the excavation drifts 22. Loaders and other similar equipment, working within the safe confines of the excavation drifts remove the resultant rubble. Preferably the rubble is carried through cross-cuts 30 to the production drift 28 for subsequent removal to the surface or to a disposal area. By gradual working back along the length of the excavation drifts from the slot 36 to the opposite end of the retort all drilling and excavating of the void space can proceed with men and equipment safely within the drifts beneath acceptable spans of unfragmented formation.

When excavation along the drifts 22 is complete, a generally triangular prism 38 of unfragmented formation remains above the production level intermediate the excavation drifts. FIG. 2 illustratively shows one such triangular prism substantially along the center of the retort and FIG. 5 illustratively shows two such triangular prisms; it being understood that any number of such prisms is within the scope of the invention, the number of prisms depending only upon the number of production level drifts excavated through the retort site. The top of each prism is preferably spaced below the lower boundry of unfragmented formation above the void space. An intermedate drift 26 extends through the center of each prism. Shot holes 44 can be drilled into the prism from the intermediate drift 26. The shot holes are then loaded with explosive and the prism is explosively expanded into the void space forming a fragmented mass 46.

Shot holes 48 are drilled into the unfragmented formation above the void space from the drilling drifts 32 or from the surface. The shot holes are grouted or otherwise plugged at the bottom end, loaded with preferably vertical columns of explosive, and then detonated to explosively expand unfragmented formation adjacent to each shothole toward the free face formed by the lower boundary 42.

Preferably the upper and lower portions of each shot hole are stemmed and explosive is loaded into the portions of the shot holes in the central region of the formation being expanded. Detonation of the explosive in shot holes 48, may be done in a signale round with explosive expansion of the unfragmented formation in prisms 38, with or without appropriate time delays to minimize the effects of seismic shock. Alternatively, the explosive in the shot holes may be detonated subsequent to explosive expansion of prisms 38. Explosive expansion of the unfragmented formation into the void space distributes the void volume of the void space into the resultant fragmented mass. The unfragmented mass in the remainder of the retort site may be explosively expanded in a single round, either with or without suitable time delays to minimize the effects of seismic shock, or in discrete lifts. By explosively expanding in "lifts" is meant that the unfragmented formation is explosively expanded in horizontal layers of formation within the retort site in an upwardly progressing time delay sequence. Explosive expansion of each horizontal layer or lift forms a new horizontal free face in an upwardly progressing sequence. The vertical shot holes 48 are essentially perpendicular to each new free and the shot holes provide access to each new free face from the drilling drifts or from the surface. Such new free faces are represented in phatom lines in FIG. 3.

Figure 7:
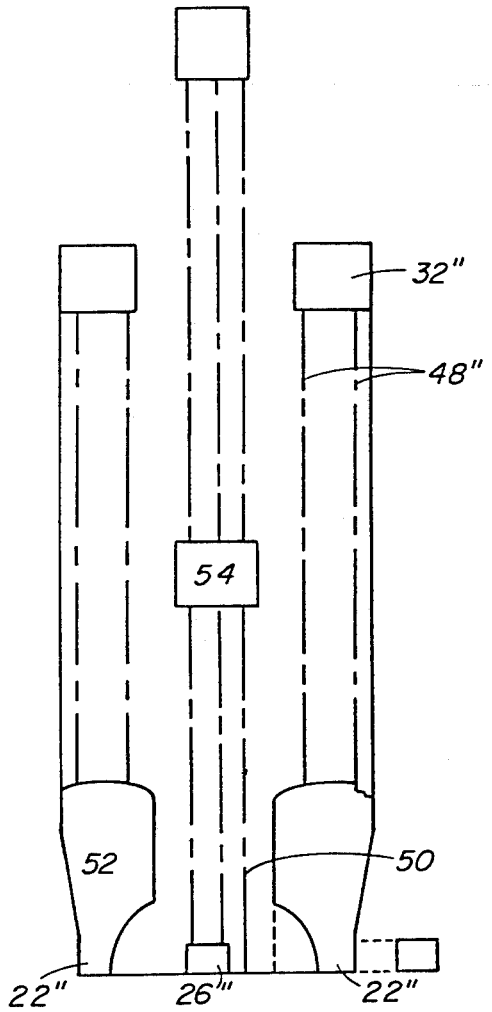

FIG. 7 illustrates another embodiment of the principles of the present invention which is particularly useful when the oil shale above the void space is not sufficiently competent to span the full width of the retort. In this embodiment, instead of completely fanning the opening above the excavation drifts 22'', thereby leaving a triangular prism of unfragmented formation beneath the unsupported unfragmented formation, a contiguous rib pillar 50 of unfragmented formation is left intermediate the excavation drifts, in contact with the unfragmented formation above and below the drifts. The voids 52 mined above the excavation drifts, separated by the rib pillar, are preferably about one-third of the width of the retort. Each of the voids 52 is excavated in the same manner described above except that the "fans" are narrow enough that they do not meet. The rib pillar temporarily supports the oil shale above the level of the voids.

Shot holes 48'' are drilled through the unfragmented formation above the voids 52 and through the rib pillar. As with the above described embodiments the shot holes may be drilled from the surface or from drilling drifts 32''. If the retort is relatively tall it may be desireable to excavate an intermediate level drift 54 to use as a site for drilling shot holes into the rib pillar 50. It is desirable for the shot holes to be as evenly spaced as possible to assure uniform fragmentation of the formation and, concomitantly, uniform distribution of the void volume in the fragmented mass. Since straight line drilling is extremely difficult and, therefore, costly any deviation in drilling accuracy is magnified in the lower portions of longer drill holes. Thus, drilling from an intermediate level drift shortens the lenght of the shot hole and improves the accuracy of the shot hole spacing. The shot holes are loaded with explosive and detonated. Preferably the rib pillar is blasted first to create the free face; thereafter, the remaining formation to be explosively expanded may be shot in a single round or in lifts.

The recovery of shale oil and gaseous products from the oil shale in the retort generally involves the movement of a retorting zone through the fragmented permeable mass of formation particles in the retort. The retorting zone can be established on the advancing side of a combustion zone in the retort or it can be established by passing heated gas through the retort. It is generally preferred to advance the retorting zone from the top to the bottom of a vertically oriented retort, i.e., a retort having vertical side boundaries. With this orientation, the shale oil and product gases produced in the retorting zone move downwardly toward the base of the retort for collection and recovery aided by the force of gravity and gases introduced at an upper elevation.

A combustion zone can be established at or near the upper boundary of a retort by any of a number of methods. Reference is made to application Ser. No. 776,234, filed Mar. 9, 1977, now U.S. Pat. No. 4,147,593, and assigned to the assignee of the present application, and incorporated herein by this reference for one method in which an upper access conduit, such as from the air level, is provided to the upper boundary of the retort and a combustible gaseous mixture is introduced therethrough and ignited in the retort. Off gas is withdrawn through a lower access means which can be excavated from the drift 28, thereby bringing about a movement of gases from top to bottom of the retort through the fragmented permeable mass of formation particles containing oil shale. A combustible gaseous mixture of a fuel, such as propane, butane, natural gas, or retort off gas, and air is introduced through the upper access conduit to the upper boundary and is ignited to initiate a combustion zone at or near the upper boundary of the retort. Combustible gaseous mixtures of oxygen and other fuels are also suitable. The supply of a combustible gaseous mixture of the combustion zone is maintained for a period sufficient for the oil shale at the upper boundary of the retort to become heated, usually to a temperature of greater than 900° F., so combustion can be sustained by the introduction of air without fuel gas into the combustion zone. Such a period can be from about one day to about a week in duration.

The combustion zone is sustained and advanced through the retort toward the lower boundary by introducing an oxygen containing retort inlet mixture through the access conduit 50 to the upper boundary of the retort, and withdrawing gas from below the retorting zone. The inlet mixture, which can be a mixture of air and a diluent such as retort off gas or water vapor, can have an oxygen content of about 10% to 20% of its volume. The retort inlet mixture is introduced to the retort at a rate of about 0.5 to 2 standard cubic feet of gas per minute per square foot of cross-sectional area of the retort.

The introduction of gas at the top and the withdrawal of off gases from the retort at a lower elevation serve to maintain a downward pressure differential of gas to carry hot combustion product gases and non-oxidized inlet gases (such as nitrogen, for example) from the combustion zone downwardly through the retort. This flow of hot gas establishes a retorting zone on the advancing side of the combustion zone wherein particulate fragmented formation containing oil shale is heated. In the retorting zone, kerogen in the oil shale is retorted to liquid and gaseous products. The liquid products, including shale oil, move by gravity toward the base of the retort where they are collected in a sump and pumped to the surface. The gaseous products from the retorting zone mix with the gases moving downwardly through the in situ retort and are removed as retort off gas from a level below the retorting zone. The retort off gas is the gas removed from such lower level of the retort and transferred to the surface. The off gas includes retort inlet mixture which does not take part in the combustion process, combustion gas generated in the combustion zone, product gas generated in the retorting zone, and carbon dioxide from decomposition of carbonates contained in the formation.

Although the method for forming an in situ oil shale retort has been described and illustrated in several embodiments, many modifications and variations will be apparent to one skilled in the art. Thus, other arrangements, wherein the vertical slot is excavated intermediate the ends of the retort site and the process of forming the void space by drilling, shotholes blasting and removal of rubble commences at the middle of the retort site and extends outwardly therefrom to the ends of the retort site are also within the scope of the present invention.

Since many such variations and modifications are contemplated, this invention should not be limited except as recited in the following claims.

What is claimed is:

1. A method of recovering liquid and gaseous products from an in situ oil shale retort formed in a retort site in a subterranean formation containing oil shale, such as in situ oil shale retort containing a fragmented permeable mass of formation particles containing oil shale, the method comprising the steps of:

a. mining at least two horizontally extending, substantially parallel excavation drifts through the retort site, the drifts having a longitudinal dimension extending along the length of the drift and a lateral dimension extending across the drift;

b. mining at least one intermediate drift through the retort site, the intermediate drift being substantially in the same plane as and substantially parallel to the excavation drifts;

c. mining a vertical slot upwardly from the upper boundary of each of the excavation drifts into the unfragmented formation above said excavation drifts, the upper end of each of the vertical slots having a larger lateral dimension than the lateral dimension of the upper boundary of the drift from which the slot was mined;

d. drilling a first set of shot holes from the excavation drifts upwardly into a first portion of the unfragmented formation above the drifts;

e. placing explosive in the shot holes and detonating the explosive to explosively expand the first portion of unfragmented formation adjacent to the first set of shot holes downwardly into the adjacent excavation drifts;

f. repeating steps (d) through (f) of drilling a set of shot holes from the excavation drifts upwardly into a portion of the unfragmented formation above the drifts, placing explosive in the shot holes, detonating the explosive and removing rubble formed thereby from the excavation drifts along the length of the excavation drifts retreating from the vertical slot to the opposite boundary of the retort site remote from the vertical slot thereby forming a vertically extending void space above each of the excavation drifts;

g. drilling a second set of shot holes into the remaining unfragmented formation in the retort site, placing explosive in the second set of shot holes and detonating the explosive to explosively expand the unfragmented formation and distribute the volume of the void excavated in steps (a) through (g) in the resultant fragmented mass;

h. establishing a retorting zone within the fragmented mass at one end thereof and advancing the retorting zone through the fragmented mass toward the other end thereof for producing liquid and gaseous products of retorting; and, i. withdrawing the liquid and gaseous products of retorting from the other end of the fragmented mass.

2. A method of recovering liquid and gaseous products as defined in claim 1 wherein the excavation drifts extend through the retort site along the bottom boundary thereof.

3. A method of recovering liquid and gaseous products as defined in claim 1 wherein the vertical slot mined above each excavation drift is laterally fanned toward the vertical slot mined above the adjacent excavation drift.

4. A method of recovering liquid and gaseous products as defined in claim 3 wherein the fanned portion of adjacent vertical slots are in communication with each other, forming a contiguous void space across the retort site, which void space overlies at least one substantially triangular prism of unfragmented formation.

5. A method of recovering liquid and gaseous products as defined in claim 4 wherein each substantially triangular prism of unfragmented formation surrounds an intermediate drift.

6. A method of recovering liquid and gaseous products as defined in claim 5 further comprising drilling shot holes into the substantially triangular prism of unfragmented formation from the intermediate drift within the said prism, placing explosive in the shot holes, and detonating the explosive to explosively expand the unfragmented formation of the substantially triangular prism into the adjacent void space.

7. A method of recovering liquid and gaseous products as defined in claim 6 wherein the explosive in the shot holes in the substantially triangular prism is detonated before the explosive in the second set of shot holes in the remaining unfragmented formation in the retort site.

8. A method of recovering liquid and gaseous products as defined in claim 1 wherein at least one drift is excavated in the subterranean formation to provide access to the retort site for drilling the second set of shot holes into the remaining unfragmented formation in the retort site.

9. A method of recovering liquid and gaseous products as defined in claim 8 wherein at least two drifts are excavated in the subterranean formation to provide access to the retort site, at least one of which drifts is excavated through the retort site.

10. A method of recovering liquid and gaseous products as defined in claim 1 wherein the remaining unfragmented formation in the retort site is explosively expanded in a single round.

11. A method of recovering liquid and gaseous products as defined in claim 1 wherein the remaining unfragmented formation in the retort site is explosively expanded in discrete lifts.

12. A method of recovering liquid and gaseous products as defined in claim 1 wherein the shot holes drilled from the excavation drifts upwardly into the unfragmented formation above the drifts are drilled parallel to the vertical slot.

13. A method of forming an in situ oil shale retort in a retort site in a subterranean formation containing oil shale, such an in situ retort having a top, a bottom and sides and containing a fragmented permeable mass of formation particles containing oil shale, the method comprising the steps of mining at least two horizontally extending substantially parallel excavation drifts through the retort site, the excavation drifts being substantially parallel to at least one of the sides of the retort; mining at least one intermediate drift through the retort site, each intermediate drift being substantially at the same elevation as and substantially parallel to the excavation drifts, each intermediate drift having an excavation drift on either side thereof; mining a vertical slot upwardly from each of the excavation drifts into a first portion of the unfragmented formation above said excavation drifts, the upper end of each of the vertical slots being larger than the bottom end thereof; drilling a first set of shot holes from the excavation drifts upwardly into the first portion of unfragmented formation above the drifts; placing explosive in the first set of shot holes and detonating the explosive to explosively expand the first portion of unfragmented formation adjacent to the first set of shot holes into the excavation drift adjacent to such first portion of unfragmented formation; removing rubble from each of the excavation drifts formed by explosive expansion of the first portion of unfragmented formation into the excavation drifts; repeating the steps of drilling shot holes, placing and detonating explosive and removing resultant rubble along the length of the excavation drifts retreating from the vertical slot to the opposite boundary of the retort site remote from the vertical slot, thereby forming vertically extending void spaces above each of the excavation drifts; and, drilling a second set of shot holes into the remaining unfragmented formation in the retort site, placing explosive in the second set of shot holes and detonating the explosive to explosively expand the remaining unfragmented formation and distribute the volume in the void spaces in the resultant fragmented mass.

14. A method of forming an in situ oil shale retort as defined in claim 13 wherein the vertical slot is mined adjacent to a boundary of the retort site.

15. A method of forming an in situ oil shale retort as defined in claim 13 wherein the excavation drifts extend through the retort site along the bottom boundary thereof.

16. A method of forming an in situ oil shale retort as defined in claim 13 wherein the vertical slot mined above each excavation drift is laterally fanned toward the vertical slot mined above the adjacent excavation drift.

17. A method of forming an in situ oil shale retort as defined in claim 16 wherein the fanned portion of adjacent vertical slots are in communication with each other, forming a contiguous void space across the retort site, which void space overlies at least one substantially triangular prism of unfragmented formation.

18. A method of forming an in situ oil shale retort as defined in claim 17 wherein each substantially triangular prism of unfragmented formation surrounds an intermediate drift.

19. A method of forming an in situ oil shale retort as defined in claim 18 wherein a third set of shot holes are drilled into the substantially triangular prism of unfragmented formation from the intermediate drift within the said prism, explosive is placed in the third set of shot holes and the explosive is detonated to explosively expand the unfragmented formation of the substantially trangular prism into the adjacent void space.

20. A method of forming an in situ oil shale retort as defined in claim 19 wherein the explosive in the third set of shot holes in the substantially triangular prism is detonated before the explosive in the second set of shot holes in the remaining unfragmented formation in the retort site.

21. A method of forming an in situ oil shale retort as defined in claim 13 wherein at least one drift is excavated in the subterranean formation to provide access to the retort site for drilling the second set of shot holes into the remaining unfragmented formation in the retort site.

22. A method of forming an in situ oil shale retort as defined in claim 21 wherein at least two drifts are excavated in the subterranean formation to provide access to the retort site, at least one of which drifts is excavated through the retort site.

23. A method of forming an in situ oil shale retort as defined in claim 13 wherein the remaining unfragmented formation in the retort site is explosively expanded in a single round.

24. A method of forming an in situ oil shale retort as defined in claim 13 wherein the remaining unfragmented formation in the retort site is explosively expanded in discrete lifts.

25. A method of forming an in situ oil shale retort as defined in claim 13 wherein the first set of shot holes drilled from the excavation drifts upwardly into the unfragmented formation above the drifts are drilled parallel to the vertical slot.

26. A method of forming an in situ oil shale retort as defined in claim 13 wherein there is unfragmented formation intermediate the vertically extending void spaces above each of the excavation voids.

27. A method of forming an in situ oil shale retort in a subterranean formation containing oil shale, such an in situ retort having a top, bottom and sides of unfragmented formation and containing a fragmented permeable mass of formation particles containing oil shale, the method comprising the steps of mining a first set of horizontally extending excavation drifts through the retort site; mining a second set of drifts through the retort site, the second set being substantially at the same elevation as and parallel to the first set, each drift in the second set having a drift of the first set on either side thereof; mining a vertical slot upwardly from each drift of the first set of drifts into a first portion of the unfragmented formation above said first set of drifts, such vertical slots being laterally fanned so that the vertical slots from adjacent drifts in the first set of drifts are in communication with each other leaving a substantially triangular prism of unfragmented formation intermediate such adjacent drifts in the first set of drifts, each of which prisms of unfragmented formation overlies a drift in the second set of drifts; drilling a first set of shot holes in a laterally fanned pattern from each of the drifts in the first set of drifts upwardly into the first portion of unfragmented formation above the first set of drifts; placing explosives in the first set of shot holes and detonating the explosives to explosively expand the first portion of unfragmented formation adjacent to such first set of shot holes into the drifts; removing rubble from the first set of drifts; repeating the steps of drilling shot holes, placing and detonating explosives and removing resultant rubble along the length of the first set of drifts within the retort site from the vertical slot to the boundary of a retort site to form a void space within the retort site and at least one prism of unfragmented formation within such void space, each of such prisms overlying a drift of the second set of drifts; drilling a second set of shot holes from each drift of the second set of drifts into the prism of unfragmented formation overlying each such drift, placing explosive in such second set of shot holes and detonating such explosive to explosively expand such prism of unfragmented formation into the void space; and, drilling a third set of shot holes into the remaining unfragmented formation within the retort site, placing explosive in such third set of shot holes and detonating such explosive to explosively expand the remaining unfragmented formation toward the void space to thereby distribute the void volume of such void space into the fragmented mass of formation particles resultant therefrom.

28. A method of forming an in situ oil shale retort as defined in claim 27 wherein there are two drifts in the first set of drifts and one drift in the second set of drifts.

29. A method of forming an in situ oil shale retort as defined in claim 27 wherein the top of the prism unfragmented formation overlying the drifts in the second set of drifts is spaced apart from the bottom of the remaining unfragmented formation in the retort site.

30. A method of forming an in situ oil shale retort as defined in claim 27 wherein the excavation drifts extend through the retort site along the bottom boundary thereof.

31. A method of forming an in situ oil shale retort as defined in claim 27 wherein the explosive in the second set of shot holes is detonated before the explosive in the third set of shot holes.

32. A method of forming an in situ oil shale retort as defined in claim 27 wherein at least one drift is excavated in the subterranean formation to provide access to the retort site for drilling the third set of shot holes into the remaining unfragmented formation in the retort site.

33. A method of forming an in situ oil shale retort as defined in claim 32 wherein at least two drifts are excavated in the subterranean formation to provide access to the retort site, at least one of which drifts is excavated through the retort site.

34. A method of forming an in situ oil shale retort as defined in claim 27 wherein the remaining unfragmented formation in the retort site is detonated in a single round.

35. A method of forming an in situ shale retort as defined in claim 27 wherein the remaining unfragmented formation in the retort site is detonated in discrete lifts.

36. A method of forming an in situ oil shale retort as defined in claim 27 wherein the shot holes drilled from the excavation drifts upwardly into the unfragmented formation above the drifts are drilled parallel to the vertical slot.

37. A method of forming an in situ oil shale retort as defined in claim 27 wherein the vertical slot is mined adjacent to a boundary of the retort site.

* * * * *